US011408119B2

(12) United States Patent
Matarasso et al.

(10) Patent No.: US 11,408,119 B2
(45) Date of Patent: Aug. 9, 2022

(54) DEVICE, METHOD AND SYSTEM FOR FOLDING A MOVING ARTICLE OF CLOTHING

(71) Applicant: Foldimate, Inc., Oak Park, CA (US)

(72) Inventors: Hasdi Matarasso, Pardess Hanna (IL); Gal Rozov, Maabarot (IL); Alon Naim, Rosh-HaAyin (IL); Isaac Naor, Hod Hasharon (IL); Neil Gabai, Herzliya (IL)

(73) Assignee: FOLDIMATE, INC., Oak Park, CA (US)

( * ) Notice: Subject to any disclaimer, the term of this patent is extended or adjusted under 35 U.S.C. 154(b) by 127 days.

(21) Appl. No.: 16/642,547

(22) PCT Filed: Aug. 16, 2018

(86) PCT No.: PCT/IL2018/050911

§ 371 (c)(1),
(2) Date: Feb. 27, 2020

(87) PCT Pub. No.: WO2019/043688

PCT Pub. Date: Mar. 7, 2019

(65) Prior Publication Data

US 2021/0079587 A1 Mar. 18, 2021

Related U.S. Application Data

(60) Provisional application No. 62/551,846, filed on Aug. 30, 2017.

(51) Int. Cl.
*D06F 89/02* (2006.01)

(52) U.S. Cl.
CPC ..... *D06F 89/02* (2013.01); *D06F 89/023* (2013.01)

(58) Field of Classification Search
CPC ... D06F 89/02; D06F 89/023; A61F 13/15747
(Continued)

(56) References Cited

U.S. PATENT DOCUMENTS 3,131,838 A 5/1964 Snayberger et al.
5,934,523 A * 8/1999 Willett ..... D06F 89/02 223/37

(Continued)

FOREIGN PATENT DOCUMENTS

WO 1988003580 A1 5/1988

OTHER PUBLICATIONS

Int'l. Search Report for PCT/IL2018/050911, dated Jan. 15, 2019.

*Primary Examiner* — Nathan E Durham
(74) *Attorney, Agent, or Firm* — Blue Filament Law PLLC

(57) ABSTRACT

A folding device (14', 14") includes a driven contact device (15', 15") configured for continuously creating a fold in a moving article (12) during an operative folding mode of the folding device. In the operative folding mode, the article moves along a base plane in a motion direction (MD). The folding device includes a support structure (54) connected to, and configured for supporting, the contact device. The contact device includes a peripheral surface (48) which extends at least partially about at least one rotation axis. The peripheral surface includes multiple fingers (44) which protrude outwardly away therefrom. In the operative folding mode, the fingers consecutively and incrementally engage and fold the article starting at an edge (28) defining an outline thereof.

20 Claims, 8 Drawing Sheets

(58) Field of Classification Search
USPC ..... 223/37
See application file for complete search history.

(56) References Cited

U.S. PATENT DOCUMENTS 6,062,444 A 5/2000 Tankersley et al.
6,776,316 B2 * 8/2004 Van Eperen ..... A61F 13/15747
223/37

* cited by examiner

DEVICE, METHOD AND SYSTEM FOR FOLDING A MOVING ARTICLE OF CLOTHING

FIELD OF THE INVENTION

The subject matter of the current application relates to automated fabric/article folding machines. Specifically, it relates to folding mechanisms for automatic or semi-automatic folding machines which fold an article as it moves.

BACKGROUND OF THE INVENTION

Automatic article folding machines designed to fold articles have existed since the beginning of the previous century. Some folding mechanisms can be more complex than others, however, many automated folding mechanisms mimic the simple folding methods that people have been using to manually fold a clothing article. In other words, during the folding operation, the article is stationary, laying on a planar surface, and it is folded in stages, e.g., one sleeve after another. Specifically, first a fold line is defined, or held down in the article, a portion of the article is then dragged by a respective edge, or pivoted across the fold line. It is a simple, but time-consuming method. These non-continuous automated folding mechanisms are often mechanically complex, slow, noisy and inefficient in terms of energy consumption and maintenance. A further disadvantage of these mechanisms is that they can only fold a narrow selection of articles, or article types. Specifically, these folding mechanisms are not designed to handle articles of different widths, or sometimes even a single article having a variable width. The main reason for this disadvantage is that size adjustability (e.g., to accommodate variable width or thickness) of a folding mechanism usually means additional mechanical and electrical complexity, which usually translates into compromising folding reliability, quality and robustness.

EP2330248B1 discloses a continuous trouser folding method and device, which includes two non-driven, or passive, brush-rollers, which roll the respective trouser legs inwards, with respect to one another during continuous motion in a motion direction. Due to a level-difference between the different paths, or motion planes, the parallel movement inwards towards the trousers centerline folds the two trouser halves by dropping one on top of the other. This method is limited in terms of clothing types, geometry and weight. Furthermore, the level difference may be problematic since it requires more room for the folding device. Another disadvantage is that the resulting fold is not a standard, 'pivoted' fold, in terms of two portions of the same article top surface being folded one onto the other (and facing each other), about a fold line. EP2330248B1 discloses a folding method where parallel movement keeps the surfaces facing in the same direction after the fold. Yet another disadvantage is not disclosed by EP2330248B1 but is easy to understand since after being folded, the waist portion of the trousers will include a twist, or entanglement which does not appear in simple, 'pivoted' folds, and will probably protrude upwards from the article.

The current invention aims to solve the above mentioned problems while achieving simultaneous continuous folding and conveyance in a folding machine.

SUMMARY OF THE INVENTION

In accordance with a first aspect according to the subject matter of the present application there is provided a folding device comprising a driven contact device configured for continuously creating a fold in a moving article during an operative folding mode of the folding device; the folding device orientation being defined with respect to a three dimensional Euclidean space described by first, second and third axes;

in the operative folding mode, the article moving along a base plane defined by the first and second axes in a motion direction parallel to the first axis;

the folding device comprising a support structure connected to and configured for supporting the contact device, the contact device comprising a peripheral surface extending at least partially about at least one rotation axis; the peripheral surface comprising multiple elongated fingers (44) protruding outwardly away therefrom;

wherein in the operative folding mode of the folding device, the fingers consecutively and incrementally engage and fold the article.

In accordance with a second aspect according to the subject matter of the present application there is provided a folding system configured for continuously creating at least one fold along a respective fold line in an article during motion thereof, the folding system comprising:

the folding device;

a conveyor configured for conveying the article in a motion direction; before being folded, the article comprising a first article surface facing away from the conveyor and a second article surface facing and contacting the conveyor; and a holding member comprising a holding member edge, only the holding member configured for holding at least a portion of the article in a direction perpendicular to the motion direction during folding, and configured for defining a fold line in the article along the holding member edge.

In accordance with a third aspect according to the subject matter of the present application there is provided a continuous article folding method comprising the following steps:

a. providing the at least one folding system;
b. enabling continuous relative motion in the motion direction between the article and the at least one folding device;
c. holding the article using the holding member;
d. using a holding member edge and establishing a fold line location and orientation in the article;
e. continuously engaging the second article surface using the fingers and collecting and folding the article over the fold line at least in a direction perpendicular to the motion direction.

In accordance with a fourth aspect according to the subject matter of the present application there is provided a clothing folding device configured to engage and fold an article of clothing moving on a clothing conveyor in a motion direction, the folding device comprising:

a support arm configured to be mounted to a clothes folding machine;

a contact device attached to the support arm such that the contact device is positioned over the clothing conveyor, when the support arm is mounted on the folding machine, the contact device comprising:

first and second pulleys spaced apart from one another along an elongation axis of the contact device, and having respective first and second rotation axes; and a belt wrapped around the spaced apart pulleys and configured to rotate in a belt rotation direction along the elongation axis, the belt having an outer belt surface provided with a plurality of elongated fingers which protrude outwardly therefrom; and a driving motor operatively connected to the contact member and configured to drive at least one of the first and second pulleys, to thereby cause the belt to rotate.

In accordance with a fifth aspect according to the subject matter of the present application there is provided a clothing folding system configured to fold a clothing article, comprising:

a clothing conveyor defining a conveyor plane and having a longitudinal axis, the clothing conveyor configured for supporting and transporting the article in a motion direction along the longitudinal axis;

a holding member having a holding member edge, and configured for holding, at least in a direction perpendicular to the motion direction, the article being transported on the clothing conveyor along the movement direction;

the folding device is positioned over the clothing conveyor, and wherein:

in a top view of the clothing conveyor, the holding member and the folding device at least partially overlap; and during an operative folding mode, as the article is transported on the clothing conveyor in the movement direction, the plurality of elongated fingers provided on the peripheral surface of the belt are configured to engage and urge an edge of the article of clothing over the holding member edge, to thereby form a fold line in the article.

Any of the following features, either alone or in combination, may be applicable to any of the above aspects of the subject matter of the application:

In a top view, the article includes first and second article surfaces and a peripheral article edge which extends therebetween and defines an outline of the article, the first article surface faces towards the contact device and the second article surface faces away from the contact device; and wherein in the operative folding mode, the respective fingers which form the fold are configured to engage mainly the article edge and the second article surface.

The folding device has a driving motor which drives the contact device, which enables continuous folding.

The peripheral surface can be an outwards facing outer belt surface of a belt which extends about at least one pulley, the rotation axis of which coincides respectively with the rotation axis.

The folding device can include first and second pulleys, each of which has first and second rotation axes; and wherein the peripheral surface is an outwards facing outer belt surface of a belt stretched about the first and second pulleys.

The peripheral surface is an outwards facing outer belt surface of a belt which has a belt velocity; and wherein in a view along the third axis, the belt velocity is either directed towards the motion direction, and forms an acute velocity angle aV therewith, or directed away from the motion direction and forms an obtuse angle 180−aV therewith.

The velocity angle aV can ranges between 30 and 70 degrees and preferably between 40 and 60 degrees.

At least one finger can have a rounded or rectangular cross section.

The fingers are made of rubber or polymer.

At least one finger can be at least partially deformable.

At least one finger can have a smooth finger peripheral surface.

Each finger has a finger top surface and a finger peripheral surface which extends therefrom towards the peripheral surface; and wherein the finger peripheral surface can include multiple ridges which protrude outwardly therefrom.

The peripheral surface can include fingers lined up in a row.

At least one finger can be curved, or includes at least one bend in a longitudinal direction thereof.

The fingers can have a finger length EL measured from the peripheral surface, and wherein the finger length EL is at least 10 mm.

The contact device has a contact device length ML and a contact device width MW; and wherein a dimension ratio LWR=ML/MW is larger than 0.5.

The holding member does not rotate about itself.

In the operative folding mode of the folding system, the article is located between the conveyor and the holding member, and the rotation axis of the contact device is located above the article and above the holding member.

In the operative folding mode of the folding system, the fold is created in the article only during relative motion in the motion direction between the article and the folding device.

The at least one rotation axis of the contact device is never perpendicular to the motion direction.

At least one finger can contact the conveyor if no article is located therebetween.

The contact device can include first and second parallel pulleys and at least one belt which is stretched thereabout.

The folding system can include two or four folding devices.

The folding system can include two or four elongated folding devices, and wherein in a top view of the folding system parallel the third axis, the respective rotation axes diverge along the motion direction.

The contact device can include two different belts arranged side-by-side, each of which can include different folding fingers.

The peripheral surface can be an outwards facing outer belt surface of a belt which has a belt velocity BV; and wherein in a view along the third axis, the belt velocity BV is either directed towards the motion direction, and forms an acute velocity angle aV therewith, or directed away from the motion direction and forms and obtuse angle 180−aV therewith.

The contact device cam have a contact device width measured along one of the rotation axes, and a contact device length perpendicular to the contact device width, along the elongation axis; and a ratio of the contact device length to the contact device width is larger than 10.

BRIEF DESCRIPTION OF THE DRAWINGS

For a better understanding of the subject matter of the present application and to show how the same may be carried out in practice, reference will now be made to the accompanying drawings, in which.

Figure 1:
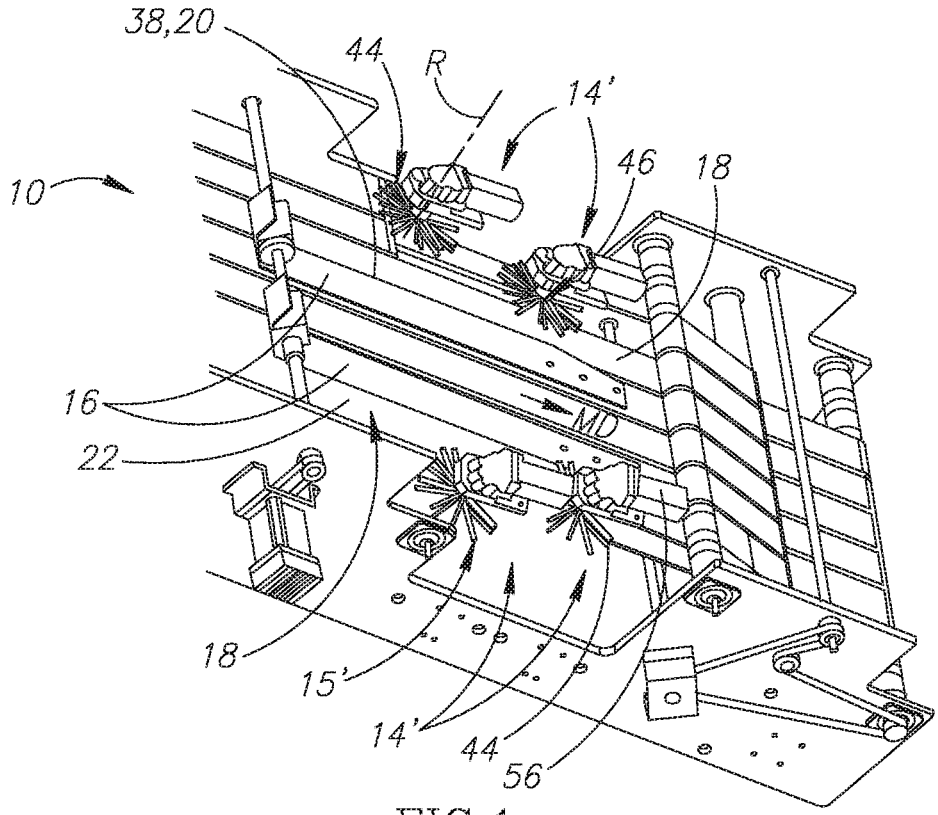
FIG. 1 is an isometric view of a folding system with four folding devices each having a round shaped contact device with a single bearing.

Where considered appropriate, reference numerals may be repeated among the figures to indicate corresponding or analogous elements.

DETAILED DESCRIPTION OF THE INVENTION

In the following description, various aspects of the subject matter of the present application will be described. For purposes of explanation, specific configurations and details are set forth in sufficient detail to provide a thorough understanding of the subject matter of the present application. However, it will also be apparent to one skilled in the art that the subject matter of the present application can be practiced without some specific configurations and details presented herein.

Figure 3:
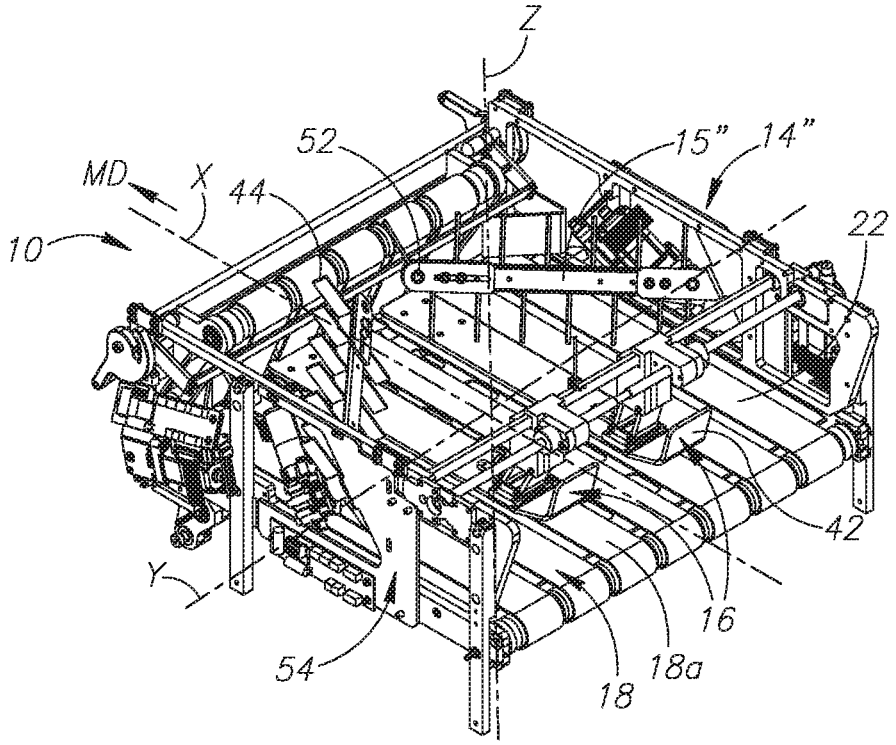
FIG. 3 is an isometric view of a folding system with two folding devices each having a support structure supporting an elongated contact device with a belt stretched about two pulleys held by two support bars.

Reference is made to FIGS. 1 and 3. A folding system 10 is an automatic motorized mechanism configured to continuously create at least one fold in an article 12 during continuous relative motion between the article 12 and a folding device 14 of the folding system 10. In a preferred embodiment, the folding device 14 is a clothes folding member 14 configured to form at least one fold in an article of clothing. According to the present embodiments, the folding system 10 is a mechanism which is designed to operate within, and/or be a part of, a preferably compact fabric/article folding machine, or system. The term relative motion is used to describe motion of either the article 12, the folding device 14 or both. Relative motion, in the current embodiments, relates to the relationship between a) the folding device 14, which has internal moving parts, but is stationary with respect to the folding machine and b) the article 12, which is conveyed beneath the folding device 14.

The folding system 10 includes a holding member 16, the folding device 14 and a relative motion mechanism 18. The holding member 16 does not rotate, as, for example a roller would about an axis of rotation. The holding member can, however, pivot about an axis to a certain degree, without rotating about it. The main goal is to allow easy passage for articles, and only create enough counter-force to form the fold in the article. The folding device 14 has a contact device 15 which engages the article 12. The relative motion mechanism 18 in the current embodiments is a clothing conveyor 18, which can include multiple mini conveyors 18*a* which together form a conveyor top surface 22. The conveyor 18 rotates such that the conveyor top surface 22 conveys the article 12 with respect to the stationary folding device 14 that continuously performs a folding operation on the article 12 across the holding member 16 to thereby define a fold line 20. During folding the article passes between the holding member 16 and the conveyor 18. The holding member 16 is configured to hold down the article 12 against the conveyor top surface 22, and the contact device 15 incrementally and continuously urges, or collects, an edge and a portion of the article 12 across the holding member's edge 30, to thereby create a fold in the article 12.

Figure 5:
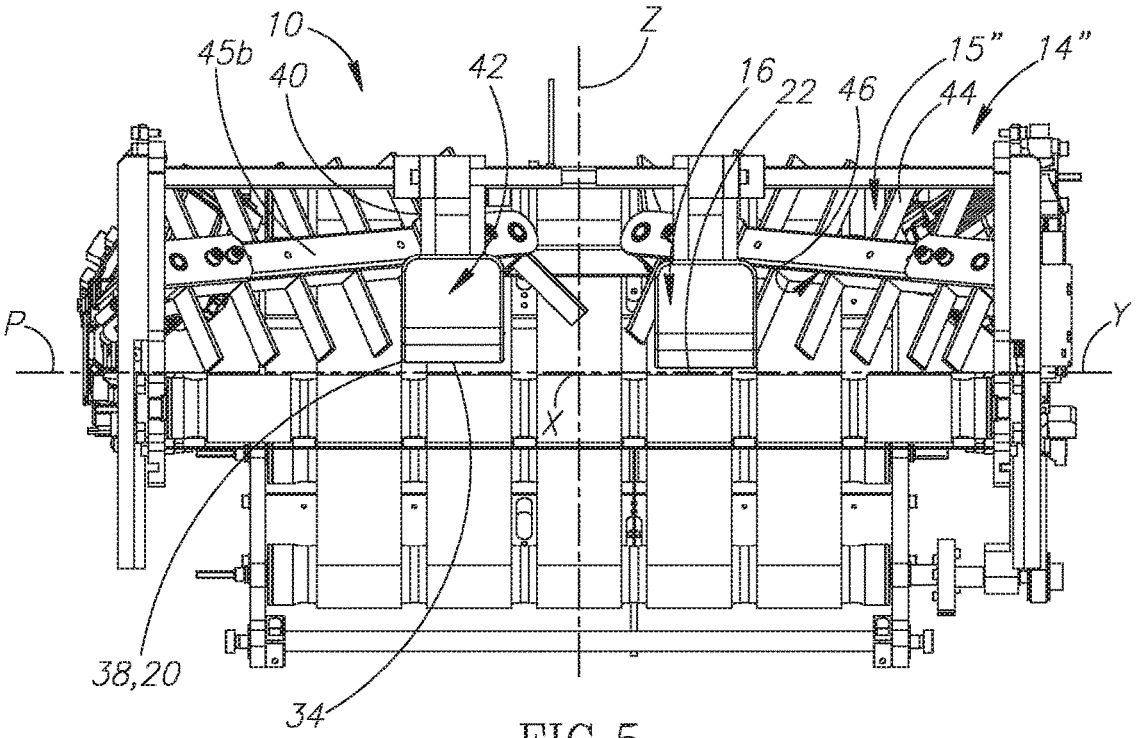
FIG. 5 is a rear view of the folding system of FIG. 3 taken along a motion direction MD.

Attention is drawn to FIGS. 3 and 5. The folding system 10 can be centered with respect to a three dimensional Euclidean space described by first, second and third axes X, Y and Z respectively. The first axis X defines a longitudinal, relative, motion direction MD, directed from the negative to the positive sides of the first axis X. The second axis Y defines a width direction. The third axis Z defines a vertical direction, the positive side being directed upwards relative to the conveyor top surface 22. The first and second axes X, Y define a base plane P which coincides with the conveyor top surface 22. In an operative folding mode, the conveyor rotates such that the top surface 22 moves in the motion direction MD, thereby conveying the article in the motion direction MD.

The article 12 can be a clothing article which may lay flat on the conveyor top surface 22. Generally speaking, only portions of the article 12 which are being folded move in the third axis Z direction during folding. According to some embodiments, the fold line 20 is oriented generally parallel to the first axis X or the motion direction MD in a view along the third axis Z.

Figure 4:
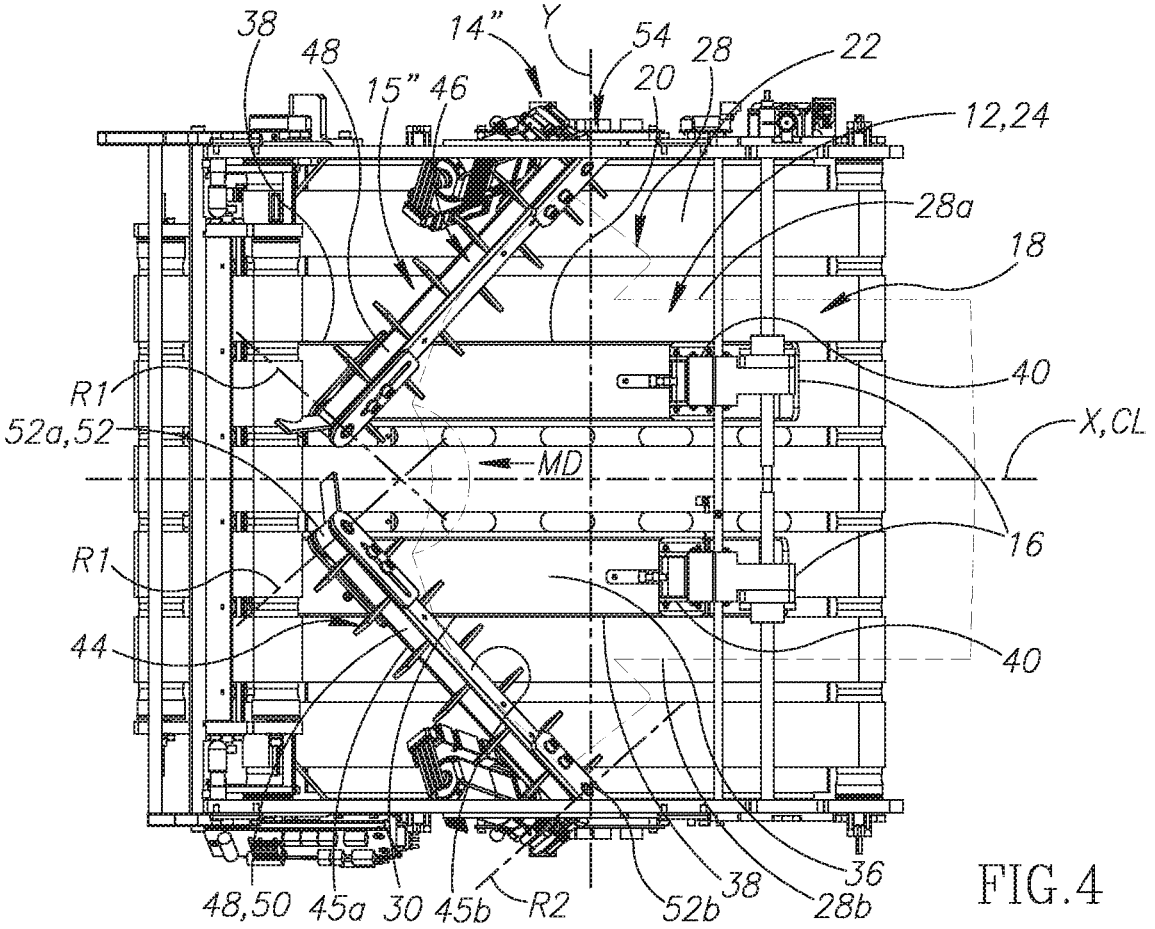
FIG. 4 is a top view of the folding system and of the conveyor of FIG. 3 taken along a third axis Z, showing a T-shirt being folded.
Figure 19:
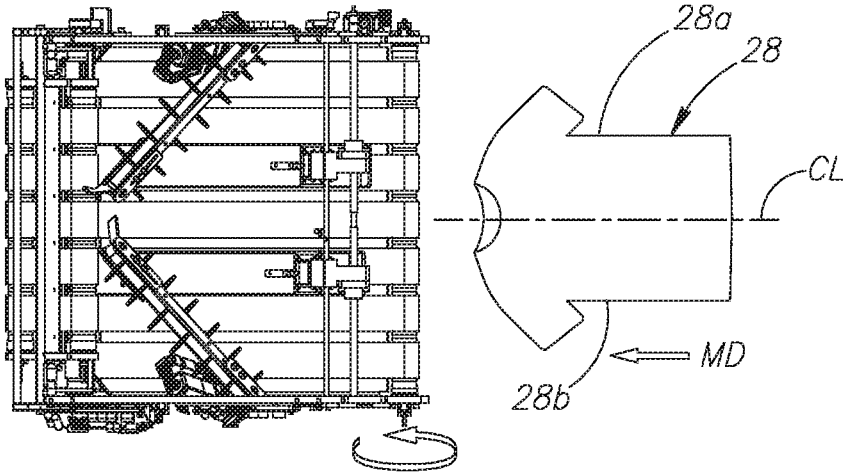
FIGS. 19-24 are plan views of the folding system of FIG. 3 showing a T-shirt moving in the motion direction MD and the different stages thereof (before, while, and after it has been folded by the folding system) as it is being conveyed by the conveyor.
Figure 20:
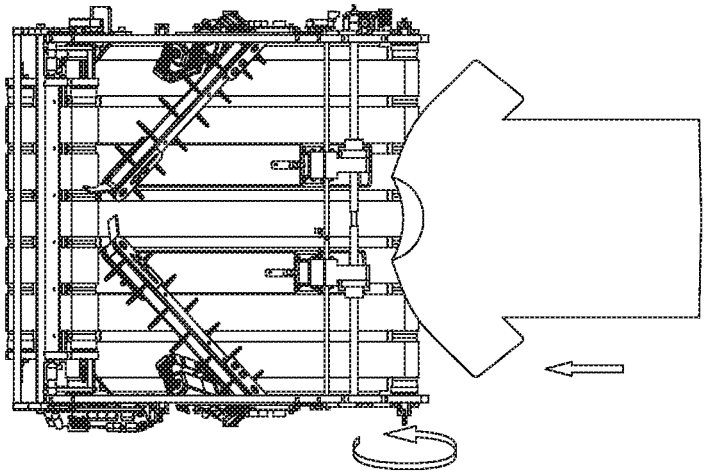
Figure 21:
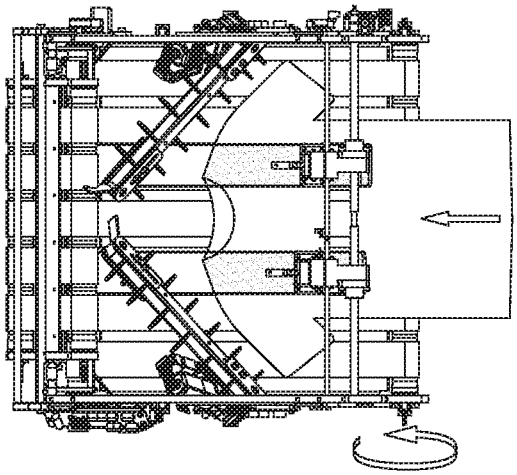
Figure 22:
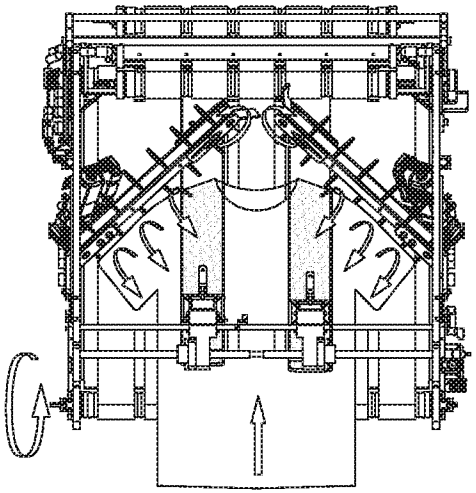
Figure 23:
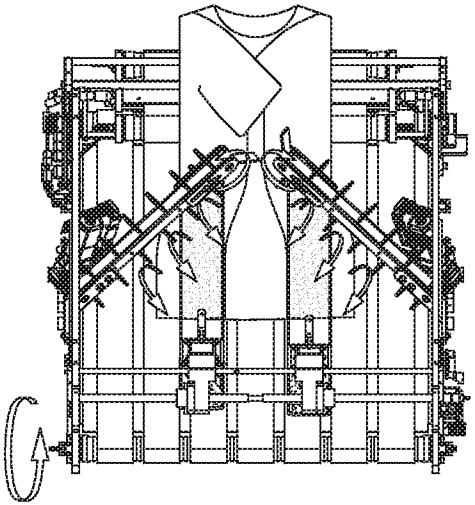
Figure 24:
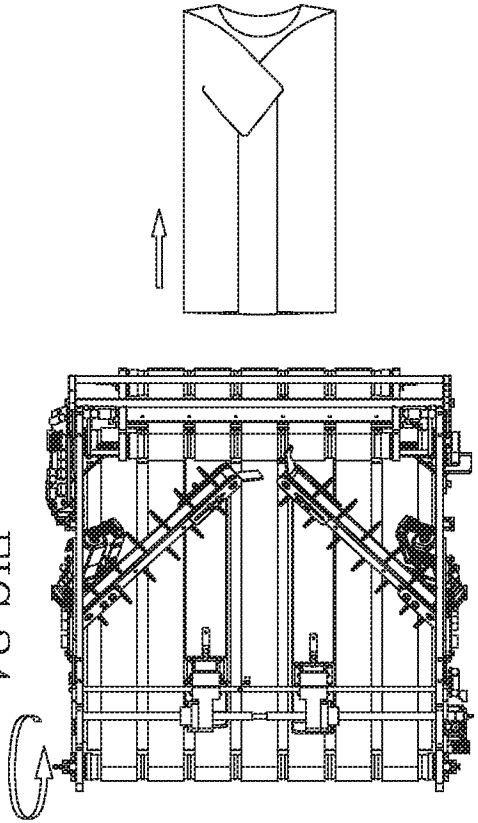

Attention is drawn to FIGS. 4 and 19-20. Before entering the folding system 10, and before enabling the relative motion, at least a portion of the article 12 has opposite first and second article surfaces 24, 26 and an external article edge 28 or outline, which extends therebetween. The article edge 28 is visible in a plan view of the first article surface 24. It is understood that an article's external article edge 28 refers to the edges of a footprint, or outline of an article 12 as it lays on the conveyor 18 or other surface before being folded, and not necessarily to the edge of the fabric constituting the article 12. For instance, a T-shirt lying flat on a surface and ready for folding is considered to have edges along the length of the T-shirt's torso, even though they are not the edges of the T-shirt's fabric.

In the current description, for the sake of explanation simplicity, it is assumed that the article 12 is neatly laid out on the conveyor top surface 22. And since gravity usually plays a part in the shape and/or behavior of the article 12, the article 12 is regarded as having a generally consistent planar, slender, or thin shape as shown at least partially in FIG. 6. In reality, although the shape, size and thickness of articles vary, the folding system 10 is capable of folding many types of articles with reliability and repeatability due to the folding device's ability to accommodate their shape, and or size, as will be further explained below. In the current embodiments, in the laid out position, the first article surface 24 is considered to face upwards, towards the positive side of the third axis Z, away from the base plane P, and the second article surface 26 is considered to face in the generally opposite direction, e.g., towards the support surface of conveyor 18. The second article surface 26 can rest on the conveyor 18.

A proper, or desired fold is formed along a fold line 20 of the article 12 in the first article surface 24, the fold line's location can be defined by a holding member edge 30 of the holding member 16. The result of creating such a fold is that a first portion of the second article surface 26 faces upwards, with a so-called borderline, or fold line 20 dividing the upward facing and now-folded first portion of the second article surface 26 from the remaining portion of the second article surface 26. This transition between the unfolded and folded positions of the first portion is facilitated by the endlessly, or continuously revolving, or rotating, contact device 15 while the article 12 is conveyed in the motion direction MD. The contact device 15 performs the fold by progressively collecting and urging, or ushering the article 12 in the second axis Y direction. Attention is drawn to FIGS. 19-24. While the article 12 progresses along the motion direction MD, the contact device 15 simultaneously works its way through the article 12, and further folds it from the article edge 28 towards the first axis X, or a center line CL of the article 12 which can coincide with the motion direction MD. This collection motion can also be described as a scooping motion. It is possible to create a fold in an article using only the folding device 14, without the holding member 16, however the fold may not be as accurate, or neat as a fold formed against the edge 30 of the holding member 16.

Figure 6:
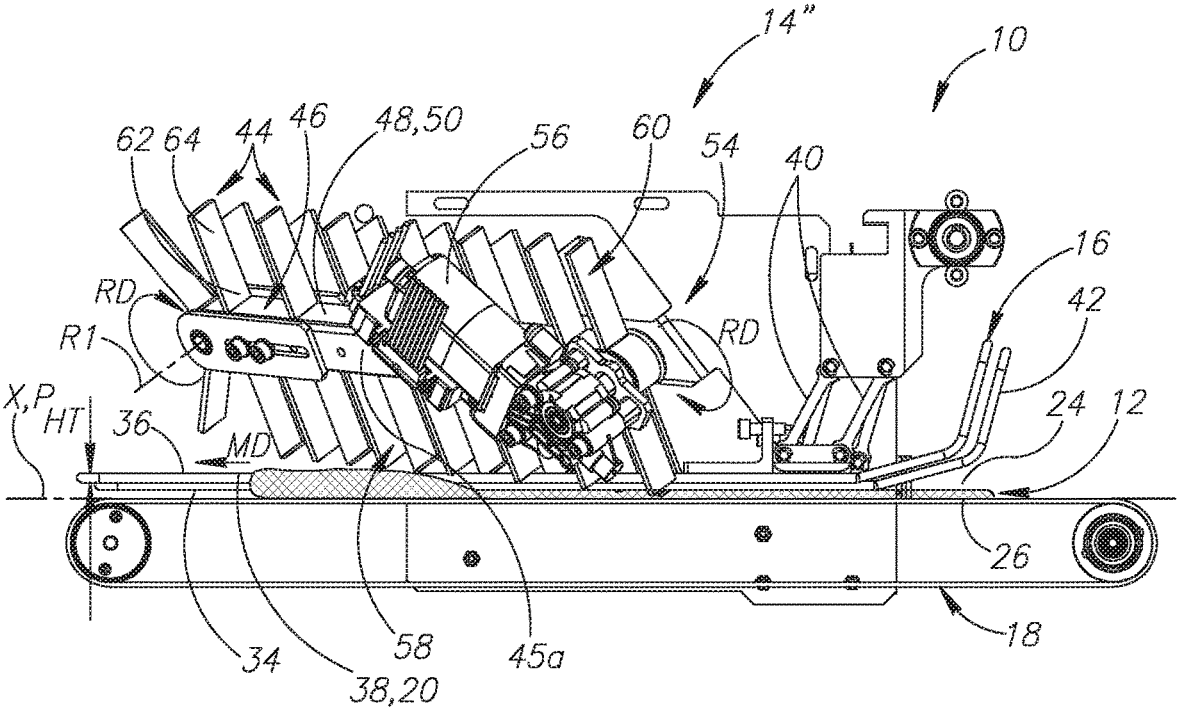
FIG. 6 is a side view of the folding system and the T-shirt being folded of FIG. 4 taken along a second axis Y (width axis Y), showing only one of the folding devices and the conveyor.
Figure 7:
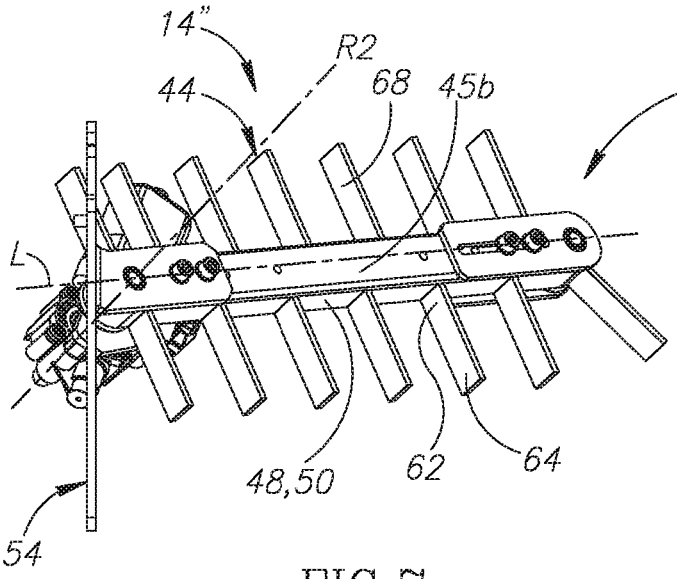
FIG. 7 is an isometric view of one of the folding devices of FIG. 5.
Figure 8:
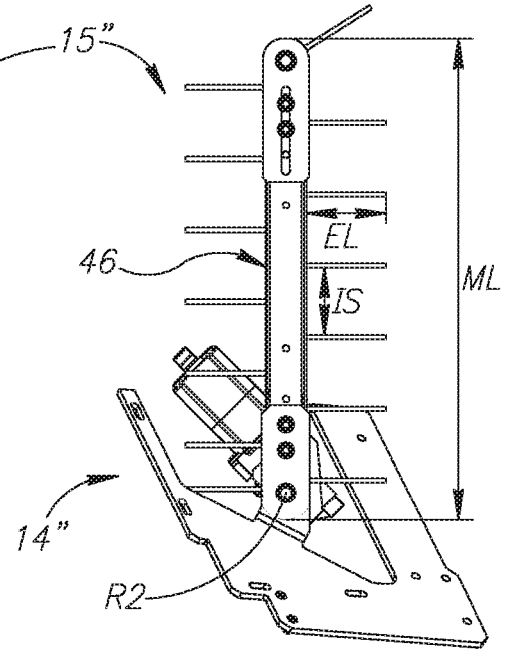
FIG. 8 is a first side view of one of the folding devices of FIG. 5 taken along a rotation axis R of the pulleys.
Figure 9:
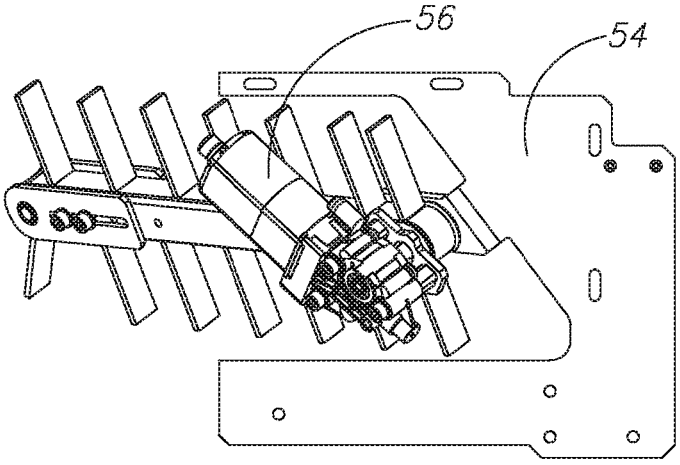
FIG. 9 is a detail view of one of the folding devices of FIG. 5 showing the motor.
Figure 10:
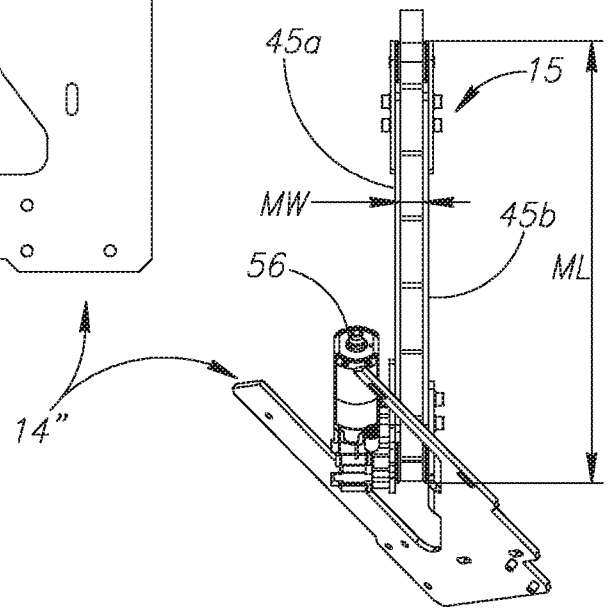
FIG. 10 is a second side view of one of the folding devices of FIG. 5 taken perpendicular to a rotation axis R of the pulleys.

Attention is drawn to FIGS. 4, 5 and 6. Each holding member 16 can have a thin, elongated plate-like structure, and the folding system 10 can include two holding members 16 which can have an adjustable position in the second axis Y. For example, the holding members 16 can be adjusted for different fold widths and article 12 width by adjusting the distance between the holding members 16 in the second axis Y direction. Each holding member 16 can have planar holding member bottom surface 34, an opposite, parallel planar holding member top surface 36 and a holding member edge 30 which extends therebetween. Each holding member 16 can have a holding member thickness HT defined between the holding member bottom and top surfaces 34, 36. The holding member thickness HT can range between 0.2 mm and 25 mm, and preferably between 1 mm and 5 mm. In the present embodiments, the holding member thickness HT equals 4 mm. As mentioned above, at least an external edge portion 38 of the holding member edge 30 defines the fold line 20. Each holding member 16 is designed to be thick enough to provide a required structural rigidity to hold the article 12 in the width direction, but also thin enough to ensure unobstructed passage of the article, and an accurate, repetitive and consistent fold line 20. Each holding member's bottom surface 34 can contact the conveyor top surface 22 before the article 12 is conveyed therebetween. Preferably, the holding member bottom surface 34 doesn't contact the conveyor.

Each holding member 16 is preferably permanently connected to the folding machine via a holding member support 40. Each holding member bottom surface 34 is preferably supported by the holding member support 40 such that it is almost weightless in the third axis Z direction, especially with respect to the conveyor top surface 22. In other words, if the holding member bottom surface 34 contacts the conveyor top surface 22, it does so with applying a minimal, or almost no force. The holding member support 40 preferably allows the holding member 16 one or two degrees of freedom of movement. One degree of freedom can be linear in the vertical direction, and a second degree of freedom can be partially rotational, with respect to a pivot mechanism, or hinges, preferably located between the holding member support 40 and the holding member 16. Nonetheless, the holding member 16 is non-rotating, in a sense that it cannot complete a full rotation about itself, or any other axis. In the present embodiments, each holding member support 40 includes a parallel movement mechanism that allows the holding member 16 to remain parallel to the conveyor top surface during movement in both the third axis Z direction and in the motion direction MD. The holding members 16 are designed with a minimum interference for the article 12, i.e., they can include a relief, or guiding portion 42 bent with respect to the rest of the holding member 16 that enables smooth entrance, or conveyance of the article 12 between the holding member 16 and the conveyor 18. Each holding member 16 is appropriately weighted and supported by the holding member support 40 to apply a counter force sufficient to hold the article 12 at least in the lateral, or width direction (second axis Y), to ensure that a proper fold line 20 is formed in the article 12. Stated differently, the fold line 20 is created in the article 12 generally parallel to the first axis X, because the holding member 16 prevents at least a portion of the article from moving in the second axis Y direction while the rest of the article 12 is incrementally and continuously ushered across the holding member edge 30. The holding member 16 therefore counters, at least at the fold line 20, forces applied on the article 12. In a top view of the conveyor 18, the holding member 16 and the folding device 14" preferably at least partially overlap.

The conveyor 18 is configured to enable relative motion between the article 12 and the folding device 14. According to the present embodiments, the conveyor 18 is a motorized conveyor, which uses friction to carry the article 12 and move it with respect to, or past, the folding device 14. In the embodiments seen in the figures, during a folding operation, the position of the folding device 14 is fixed relative to the conveyor 18, such as by being rigidly attached to a structural member of the folding system 10 or the folding machine itself. Although the position of the folding device 14 is fixed during a folding operation, at least the contact device 15 of the folding device 14, must be in motion, as will be further explained below.

According to the present embodiments, the conveyor 18 refers to multiple, side-by-side smaller conveyors **18*a*, which form, or define the conveyor top surface 22 on which the article 12 is placed. In a plan view of the conveyor 18 in the third axis Z direction (see FIG. 17), the conveyor 18** has a conveyor width CW measured between extremities thereof parallel to the second axis Y direction.

Attention is drawn to FIGS. 7-10 and 16-18 showing a single contact device 15. The contact device 15 is configured to contact the article 12 and continuously fold the article 12, starting at its article edge 28. The contact device 15 folds the article 12 by grabbing and dragging the article edge 28 and by moving at least the article edge 28 across the holding member edge 30.

According to the present example, the contact device 15 is connected to a stationary, or rigid, support structure, or arm 54 which, in turn, is connected to the folding machine. The support structure 54, as its name suggests, supports the contact device 15 in a specific orientation with respect to the three dimensional Euclidean space, while at least a portion of the contact device 15 is continuously moving during folding as will be explained below.

Figure 17:
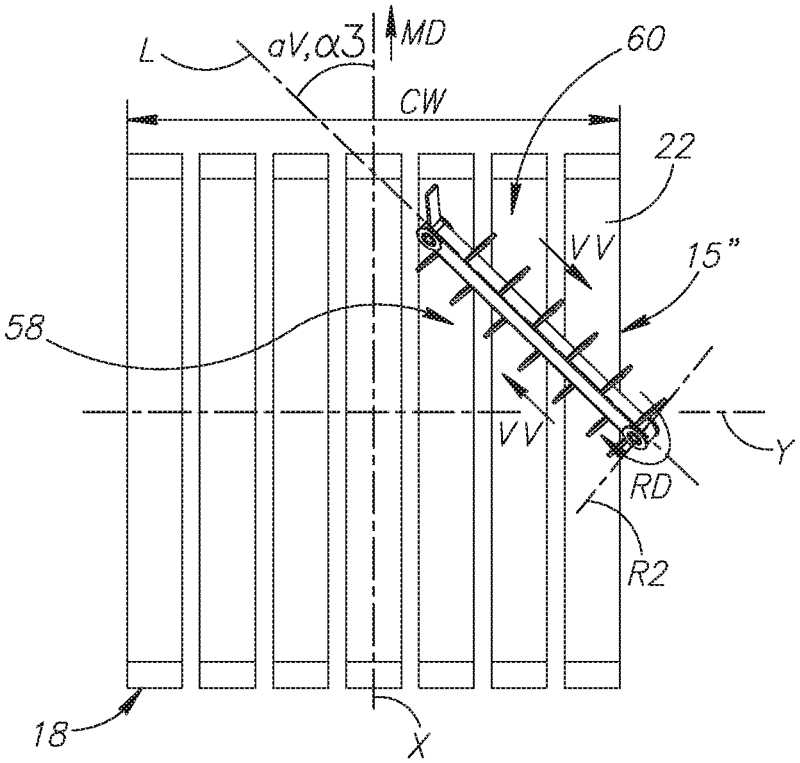
FIG. 17 is a top plan view of the folding system of FIG. 16.
Figure 18:
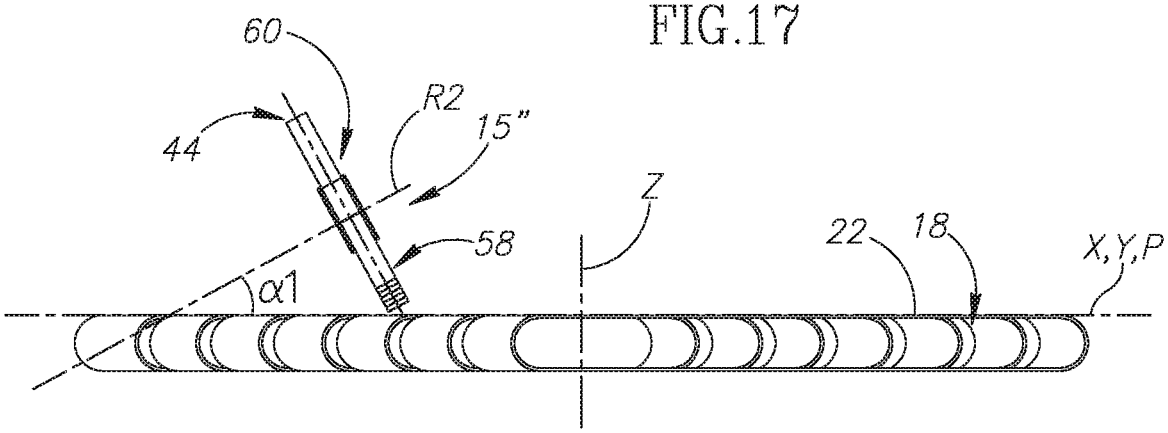
FIG. 18 is a side view of the folding system of FIG. 16 taken perpendicular to the third axis Z.

The contact device 15 has a peripheral surface 48 which extends at least partially about, or around, at least one rotation axis R which defines a movement, or rotation, direction RD as shown in FIG. 17. The at least one rotation axis R is not perpendicular to the motion direction MD, otherwise, the contact device 15 would either pull the article in the motion direction MD with respect to the conveyor, or roll it in the opposite direction. In any case, it would not create a desired width fold along the motion direction MD. The contact device 15 has a plurality of extensions, or fingers 44 which extend outwardly away from the peripheral surface 48. The fingers 44 can be made of rubber of polymer. At least one finger 44 can be at least partially deformable, preferably elastically deformable. According to some embodiments, at least one finger 44 is curved, or comprises at least one bend in a longitudinal direction thereof. The contact device 15 can include a belt 46 which extends in the rotation direction RD. The belt 46 has an outer belt surface 50. In the present embodiment, the peripheral surface 48 is the outer belt surface 50. The belt 46 is at least partially deformable, or flexible, and can be stretched about a pair of rollers, or pulleys 52. Each roller 52 has a rotation axis R1, R2, one of which may coincide with a motor 56 drive axis. The rotation axis R2 forms a first angle a1 with the base plane P (FIG. 18). In this embodiment, the pulleys are held at a constant distance from each other via first and second support bars 45*a*, 45*b*.

Attention is drawn to FIGS. 7-10. The contact device 15 is preferably rigidly attached onto the support structure 54 which supports and suspends the contact device 15 with respect to the moving article 12. In the current embodiment, the support structure 54 is rigidly attached to the second support bar 45*b*. According to the present embodiment, the support arm 54 is rigidly and permanently attached to the folding machine or a stationary skeletal structure thereof as shown in FIGS. 3-5. Attention is drawn to FIGS. 16-18. In a top view of the conveyor, as seen in FIG. 17, the contact device 15 is oriented at an angle relative to the motion direction MD. As will be explained below, the elongated contact device 15 is oriented in a manner such that two contact devices 15, working in tandem, cover the majority of the conveyor width CW, and consequently the width, in the second axis Y, of an entire article 12. This is advantageous because different articles 12 with different widths can be folded without moving or adjusting the position/orientation of the contact devices 15.

Each contact device 15 can be driven by the electric motor 56. The motor 56 can be directly attached to, and drive, a respective pulley 52 in the rotation direction RD, however, any other direct or indirect driving method can be employed.

The belt 46 has an inner belt surface 49, an opposite, outer belt surface 50 and a total belt length BL. The inner belt surface can have torque transfer ridges 49*a* which enable torque transfer between the belt 46 and the roller, or pulley 52. In the current embodiment, where there are two folding devices 14" covering almost the entire conveyor width CW, and BL/2 is preferably at least 50% of the conveyor width CW. In the top view of the folding system 10 parallel the third axis Z, the respective rotation axes R of the two folding devices 14" diverge along the motion direction MD. This orientation was found to give the best results in terms or repeatability, reliability and article variability.

At any given instant during a folding operation, the belt 46 has operative and inoperative belt portions 58, 60, each having a slightly shorter length than BL/2. The operative belt portion 58 extends between the pulleys 52 and faces at least partially downwards, towards the conveyor 18, and the article 12. The inoperative belt portion 60 is located farther away from the article 12 than the respective rotation axis R.

The belt 46 revolves, or moves in the rotation direction RD. The rotation direction RD is always directed such that the operative belt portion 58 has a velocity vector VV which is at least partially directed in the motion direction MD. In other words, as shown in FIG. 17, in a top or plan view of the conveyor 18 and the article 12, the velocity vector VV forms an acute velocity angle aV with the motion direction MD. The velocity angle aV can range between 30 and 70 degrees, and preferably between 40 and 60 degrees. According to the present embodiment, the velocity angle aV equals 50 degrees. The operative belt portion 58 therefore has a velocity component in the second axis Y direction which helps fold the fabric, but also a velocity component in the motion direction MD, to conform to, or assist with, the 'flow' of the article 12, to ensure smooth conveyance and to avoid article jams. These velocity components also generally reflect the orientation of the force vectors that are exerted onto the fabric by the elongated fingers 44 of the operative belt portion 58.

Figure 13:
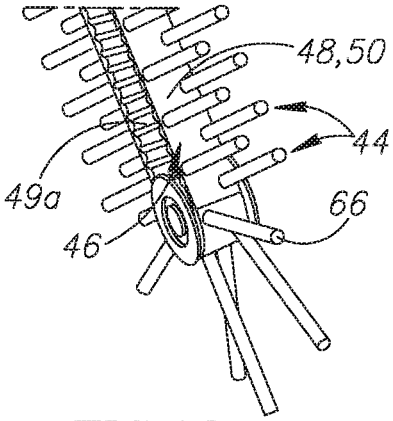
FIG. 13 is a detail isometric view of a third embodiment of a contact device with two rows of elongated fingers, each finger having a round cross section.
Figure 14:
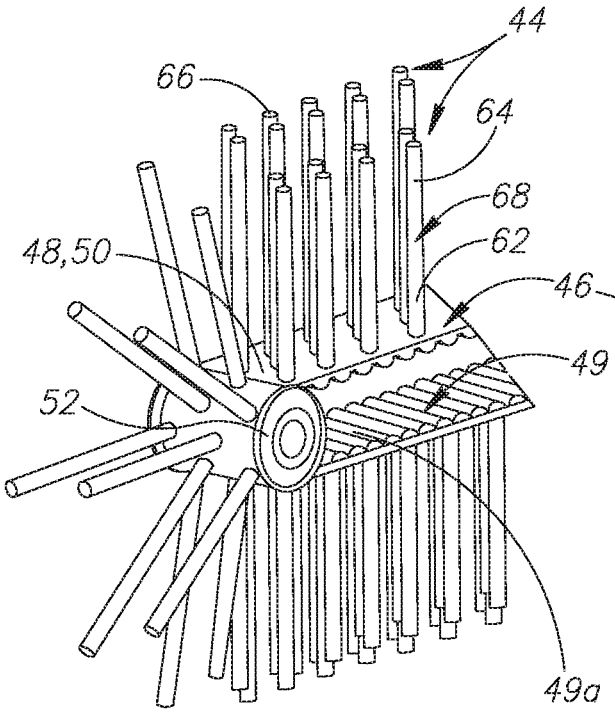
FIG. 14 is a detail isometric view of a fourth embodiment of a contact device with two rows of elongated fingers, each row having a different finger length EL, and each finger having a round cross section.
Figure 15:
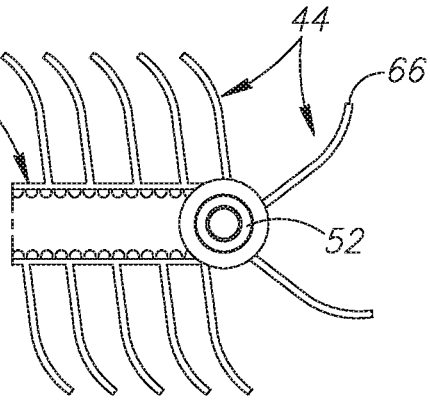
FIG. 15 is a first side view of a fifth embodiment of a contact device taken along a rotation axis R and showing curved elongated fingers which include a bend.
Figure 16:
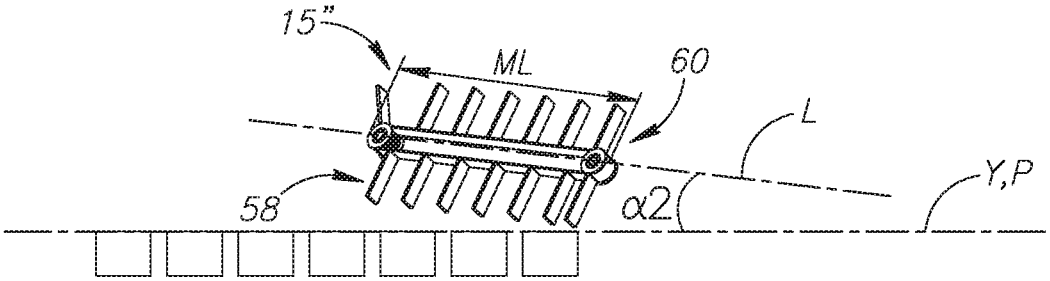
FIG. 16 is a rear view of the folding system of FIG. 3 taken along a motion direction MD, showing the conveyor with a base plane P and only one of the two contact devices with the support structure, the support bars, and holding members removed.

The belt 46 has a belt velocity BV which can range between 200 mm/s and 1000 mm/s, depending on the velocity angle Av. According to the present embodiment, the belt velocity equals 540 mm/s. According to the current embodiment, the belt 46 can include multiple elongated fingers 44 which are aligned consecutively in a single row. According to some embodiments the belt 46 has two rows of elongated fingers 44, e.g. as shown in FIGS. 13 and 14. In these embodiments, the contact device 15 can have two different belts 46 arranged side-by-side, each of which comprises different row of fingers 44. The elongated fingers 44 are spaced apart from each other in a belt longitudinal direction BL which is perpendicular to the rotation axis R2. In a side view of the belt 46, along the rotation axis R2, an interval space IS is defined as a minimal distance measured perpendicular to the rotation axis R on the outer belt surface 50 between adjacent elongated fingers 44 in a single row. The interval space IS preferably ranges between 10 mm and 70 mm, more preferably between 40 and 60 mm, and according to the present embodiments, the interval space IS equals 50 mm.

For each folding system 10 with the second embodiment of the contact device 15", it was found that mathematical links can be defined between, e.g., the linear belt velocity BV and a conveyor velocity CV. For example, BV=(CV*SC)/Cos(aV). A speed ratio constant SC was empirically discovered, and can range between 0.8 and 1.4, and preferably between 1 and 1.2. If the belt velocity BV is too high with respect to the conveyor velocity CV, the contact device (15) could, e.g., cause the article 12 to displace with respect to the conveyor 18. On the other hand, if the belt velocity BV is too slow, the contact device could, e.g., stretch the fabric. In both cases, article jams can occur. In a view along the third axis Z, the belt velocity BV is either directed towards the motion direction MD, and forms an acute velocity angle aV therewith, or directed away from the motion direction MD and forms an obtuse angle 180−aV therewith.

Attention is drawn to FIG. 8 and FIGS. 11-15. Each elongated finger can have, e.g., a polygonal or rounded cross section. During experiments, a correlation was found between certain shapes of the cross section of each finger 44 and the general fold quality and/or efficiency. Each finger 44 preferably has a rectangular or round cross section, both of which were found to produce the best results. Specifically, the rectangular cross section was generally cheaper to produce than the round cross section. In accordance with a folding application and/or article 12 attributes, such as external measurements, rigidity/flexibility, density, texture etc., the elongated fingers 44 can have a corresponding, or appropriate cross section.

According to the present embodiments, each elongated finger 44 has opposite base and main finger portions 62, 64. The base finger portion 62 is preferably permanently connected (i.e., non-removable without damage) to the peripheral surface 48, or outer belt surface 50. On the inoperative belt portion 60, i.e., in a non-engaged position of the elongated finger 44, the elongated finger 44 has a finger length EL which is measured between the peripheral surface 48, or outer belt surface 50, and an extremity of the elongated finger 44 on the main finger portion 64. The finger length EL can range between and 10 mm and 130 mm and preferably between 30 mm and 100 mm. In the current embodiments, the finger length equals 50 mm. According to the present embodiments, on the operative belt portion 58, the fingers 44 closest to the conveyor 18 can touch the conveyor 18. Preferably, in a non-operative mode, at least one finger 44 is either in contact with the conveyor 18, or located not more than 1 mm away from the conveyor 18. The advantage being that even very thin fabric will be 'caught' by the fingers and 44 will be eventually folded. In the operative folding mode, the respective fingers 44 which form the fold (engage the article 12) are configured to engage mainly the article edge 28 and the second article surface 28.

Figure 11:
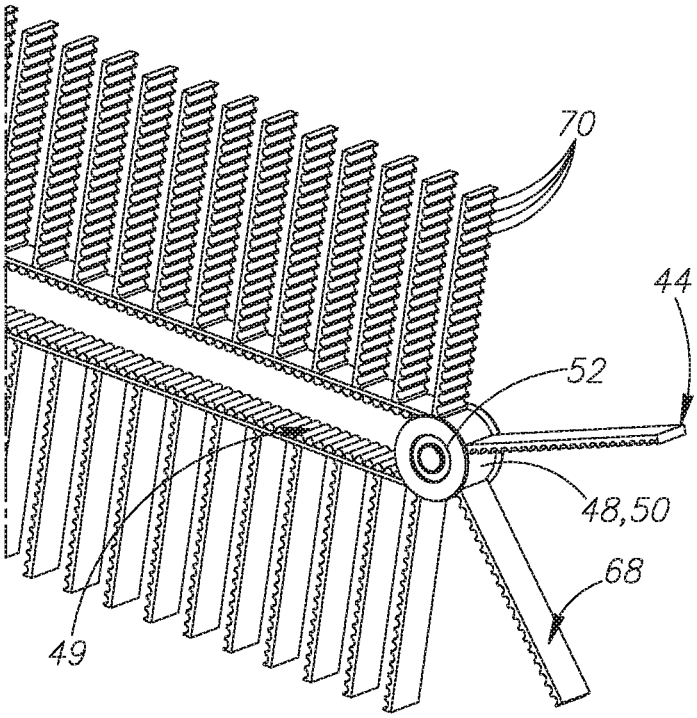
FIG. 11 is an isometric view of a first embodiment of a contact device whose elongated fingers include ridges.
Figure 12:
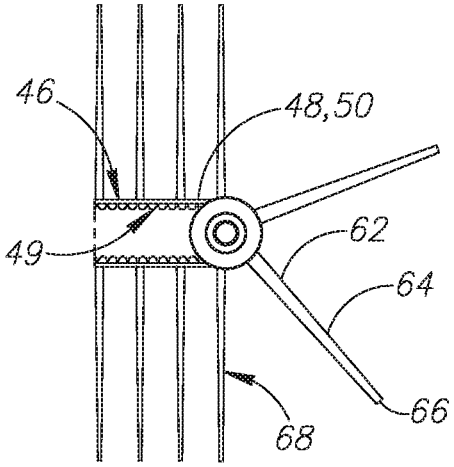
FIG. 12 is a detail first side view of a second embodiment of a contact device whose elongated fingers have decreasing width when proceeding along each finger away from the belt, or a peripheral surface of the contact device.

Each elongated finger 44 can have a finger top surface 66 and a finger peripheral surface 68 which extends towards the outer belt surface 50. In some embodiments, at least one finger 44 has a smooth finger peripheral surface 68. In other words, the finger peripheral surface 68 can be without ridges, or protrusions. According to some embodiments, each finger peripheral surface 68 can include ridges 70 which protrude therefrom, as seen in FIG. 11. These ridges 70 can improve article handling with some materials, by supplying added friction.

As seen the rear view of FIG. 5, in the third axis Z direction, the conveyor 18 is located beneath the holding member 16, and the holding member 16 is located beneath the contact device 15. The pulleys 52 and belt 46 of each contact device 15 are spaced apart from the conveyor 18. However, at least some of the elongated fingers 44 can be in contact with the conveyor 18. This can ensure that even the thinnest fabric/article 12 is engaged by the elongated fingers 44 and folded correctly.

According to the present embodiments, in an operative folding mode of the folding system 10, the article 12 is moving, or conveyed through the folding system 10. The article 12 rests on the conveyor top surface 22, which rotates, and conveys the article 12 under the holding member 16. In the operative folding mode, the article 12 is located between the conveyor 18 and the holding member 16, and the rotation axis R, R1, R2 of the contact device 15', 15" is located above the article 12 and above the holding member 16.

Figure 2:
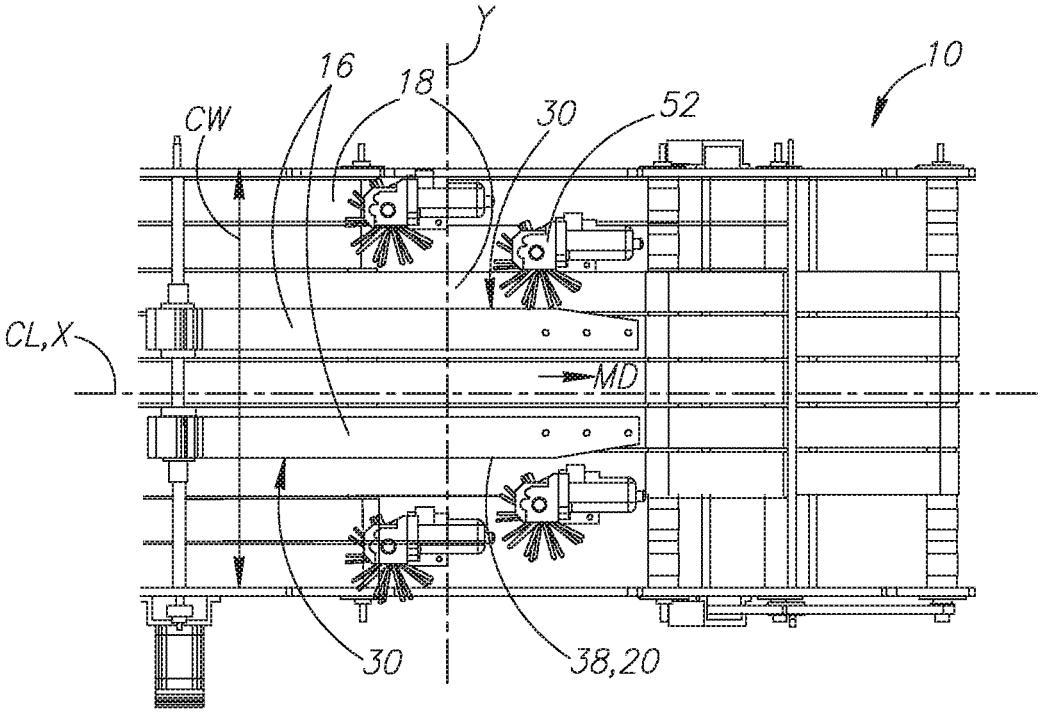
FIG. 2 is a top plan view of the folding system of FIG. 1.

Attention is drawn to FIGS. 1 and 2 showing a folding system 10 having a first embodiment of a folding device 14'. The folding device 14' of the first embodiment has only single roller 52 with rotation axis R and the motor 56 may have an output axis coincident with the contact device's sole rotation axis R. Thus, in the folding system 10 seen in FIGS. 1 and 2, the contact device 15', and consequently the peripheral surface 48, have a generally round shape in a view along the rotation axis R. The peripheral surface 48 can extend about, or be a part of, a roller 52 which can be centered, and rotates, about the rotation axis R. As seen in FIGS. 1 and 2, the folding system 10 has two pairs of folding devices 14', each pair configured to handle different article widths. Members of the inner pair of folding devices 14' are located closer to one another than members of the other, outer pair. Each folding device 14' of each pair is located on opposite sides of the folding system 10, or article 12, in the second axis Y (width) direction. In the case of the folding device 14' seen in FIGS. 1 and 2, the first angle $\alpha$1 can range between 1 and 44 degrees and preferably between 20 to 40 degrees. According to the present embodiments, the first angle $\alpha$1 equals 30 degrees.

Attention is drawn to FIGS. 3-5 showing a folding system 10 having a second embodiment of a folding device 14". In FIGS. 3-5, each contact device 15 includes first and second pulleys 52*a*, 52*b* and the belt 46 which extends thereabout in an oval fashion. This second embodiment of the contact device 15" can also be referred to as a conveyor-type, or belt-type contact device 15", due to the structure resemblance. The contact device 15 is not configured, or intended, for holding, ironing, or similar operations performed on fabrics. In this second embodiment of the folding device 14", the peripheral surface 48 is the outwards facing outer belt surface 50. The belt 46 includes multiple elongated fingers 44. The first and second pulleys 52*a*, 52*b* have respective first and second rotation axes R1, R2 which can be parallel to one another. In the case of the folding member 14" seen in FIGS. 3-5, the first angle $\alpha$1 ranges between 1 and 44 degrees and preferably between 15 to 40 degrees. According to the present embodiments, the first angle $\alpha$1 equals 30 degrees.

The contact device 15" has a contact device elongation axis L which is defined to extend along a direction corresponding to the direction where the shortest distance is measured between the first and second rotation axes R1, R2. The contact device elongation axis L is located midway between, the operative and inoperative belt portions 58, 60. The contact device elongation axis L can be perpendicular to the first and second rotation axes R1, R2. The contact device elongation axis L is parallel to the belt longitudinal direction BL.

A contact device length ML is defined perpendicular to any of the rotation axes R, R1, R2, between the farthest extremities of the peripheral surface 48. According to the second embodiment of the contact device, the contact device length ML can range between 20 and 70 percent of the conveyor width CW and preferably between 30 and 50 percent of the conveyor width CW. According to the present embodiments, the contact device length ML equals 40 percent of the conveyor width CW. The contact device length ML can range between 190 mm and 320 mm. According to the present embodiments, the contact device length ML equals 270 mm.

In the current embodiments, the contact device 15', 15" has a contact device width MW is defined in a direction parallel to any of the rotation axes R, R1 or R2 between farthest extremities of the peripheral surface 48. The contact device width MW can range between 4 mm and 50 mm. According to the present embodiments, the contact device width MW equals 15 mm. A length to width ratio, or a dimension ratio LWR=MW/ML is defined between the contact device length ML and the contact device width MW. According to the present embodiment, the dimension ratio LWR ranges between 0.5 and 25, and preferably between 10 and 20. In the present embodiments, the dimension ratio LWR equals 20.

In a view along the first axis X (FIG. 16), the contact device elongation axis L forms an acute second angle $\alpha 2$ with the base plane P. The second angle $\alpha 2$ ranges between 0 and 7 degrees, and preferably between 0 and 5 degrees. In the second embodiment, the second angle $\alpha 2$ equals 3.5 degrees. The second angle $\alpha 2$ can be regarded as a relief angle, which creates an increasing gap between the fingers 44 of the operative belt portion 58 and the conveyor 18. This increases the adaptability and reliability of the folding system in order to fold various thicknesses, and types, of fabric.

In a plan view of the conveyor top surface 22 along the third axis Z (FIG. 17), the contact device elongation axis L forms a third angle $\alpha 3$ with the motion direction MD, which can range between 20 and 80 degrees and preferably between 35 and 75 degrees. In the second embodiment, the third angle is 50 degrees.

All of the above mentioned angles ratios and measurements are direct results of a rigorous and constant optimization and research and development process, which led to these numbers. The goal of this effort has been to find a balance between cost-effectiveness and versatility of the folding system 10.

Attention is drawn to FIGS. 19-24. According to the subject matter of the present application a continuous folding method includes the following steps:

a. providing the at least one folding system 10;
b. enabling continuous relative motion in the motion direction MD between the article 12 and the at least one folding device 14', 14";
c. holding the article 12 using the holding member (16);
d. using a holding member edge 30 and establishing a fold line 20 location and orientation in the article 12;
e. continuously engaging the second article surface 26 using the fingers 44 and collecting and folding the article 12 over the fold line 20 at least in a direction perpendicular to the motion direction MD.

Attention is drawn to FIGS. 19-24. According to the subject matter of the present application a further continuous folding method includes the following steps:

a) Enabling continuous relative motion in the motion direction MD between the article 12 and at least one folding device 14', 14";
b) Holding the article 12 using the holding member 16;
c) Using a holding member edge 30 and establishing a fold line 20 location and orientation in the article 12;
d) Engaging the second article surface 26 using the continuously rotating contact device 15', 15"; and
e) Using the fingers 44 for collecting and folding the article 12 over the fold line 20 at least in a direction perpendicular to the motion direction MD.

There is further provided a folding method which includes the following steps:

a) Conveying an article 12 in the motion direction MD which coincides with the article central axis CL;
b) Collecting and folding the second article surface 26 of the article 12 with a scooping motion towards the central axis CL; and
c) Repeating the previous step until the article 12 sides/lateral extremities have been folded.
d)

There is further provided a folding method which includes the following steps:

a) Using the conveyor 18 to continuously convey the article 12 across the holding member 16 in the motion direction MD;
b) In a top view of the article 12, continuously and intermittently applying forces on the article 12 in the motion direction MD and in the second axis Y direction towards the first axis X; and
c) In a view along the second axis Y, continuously and intermittently applying forces on the article 12 in a direction between the motion direction MD and the vertical direction, or the third axis Z There is further provided a an article folding method for folding the article (12) which includes opposing first and second article lateral edges 28*a*, 28*b*, and an article center line CL passing between the article lateral edges 28*a*, 28*b*, the method comprising:

(a) conveying the article 12 in a motion direction MD which coincides with an article central axis CL; and
(b) while the article moves in the motion direction MD, successively collecting and folding incremental portions of the article's first lateral edge 28*a* towards the center line CL, until at least an entire section of the first lateral edge 28*a* is folded over the second article surface 26; and, preferably,
(c) while the article moves in the motion direction MD, successively collecting and folding incremental portions of the article's opposite second lateral edge 28*b* towards the center line CL, until at least an entire section of the second lateral edge 28*h* is folded over the second article surface 28.

In a preferable embodiment, steps (b) and (c) of this folding method occur simultaneously.

The invention claimed is:

1. A folding device (14', 14") comprising a driven contact device (15', 15") configured for continuously creating a fold in a moving article (12) during an operative folding mode of the folding device (14' 14"); an orientation of the folding device (14', 14") being defined with respect to a three dimensional euclidean space described by first, second and third axes (X, Y, Z);

in the operative folding mode, the article (12) moving along a base plane (P) defined by, the first and second axes (X, Y), in a motion direction (MD) parallel to the first axis (X); the folding device (14', 14") comprising a support structure (54) connected to, and configured for supporting, the contact device (15', 15"), the contact device (15', 15") comprising a peripheral surface (48) extending at least partially about at least one rotation axis (R, R1, R2); the peripheral surface (48) comprising multiple elongated fingers (44) protruding outwardly away therefrom;

wherein in the operative folding mode of the folding device (14' 14"), the fingers (44) consecutively engage, and incrementally fold, the article (12).

2. The folding device (14', 14") according to claim 1, wherein the article (12) comprises first and second article surfaces (24, 26) and a peripheral article edge (28) which extends therebetween and defines an outline of the article (12), the first article surface (24) faces towards the contact device (1.5', 15") and the second article surface (26) faces away from the contact device (15', 15"); and wherein in the operative folding mode, the elongated fingers (44) which form the fold are configured to engage at least the article edge (28) and the second article surface (26).

3. The folding device (14', 14") according to claim 1, wherein the folding device (14', 14") has a driving motor (56) which drives the contact device (15', 15"), which enables continuous folding.

4. The folding device (14', 14") according to claim 1, wherein the peripheral surface (48) is an outwards facing outer belt surface (50) of a belt (46) which extends about at least one pulley (52), the rotation axis of which coincides respectively with a rotation axis (R).

5. The folding device (14', 14") according to claim 1, wherein the folding device (14") comprises first and second pulleys (52*a*, 52*b*), each of which has first and second rotation axes (R1, R2); and wherein the peripheral surface (48) is an outwards facing outer belt surface (50) of a belt (46) stretched about the first and second pulleys (52*a*, 52*b*).

6. The folding device (14") according to claim 5, wherein the peripheral surface (48) has a belt velocity (BV); and wherein the belt velocity (BV) is either directed towards the motion direction (MD), and forms an acute velocity angle (aV) therewith, or directed away from the motion direction (MD) and forms an obtuse angle (180−aV) therewith.

7. The folding device (14") according to claim 6, wherein the acute velocity angle (aV) ranges between 30 and 70 degrees and preferably between 40 and 60 degrees.

8. The folding device (14', 14") according to claim 1, wherein at least one finger (44) is at least partially deformable.

9. The folding device (14', 14") according to claim 1, wherein each finger (44) has a finger top surface (66) and a finger peripheral surface (68) which extends therefrom towards the peripheral surface (48); and wherein the finger peripheral surface (68) has multiple ridges (70) which protrude outwardly therefrom.

10. The folding device (14', 14") according to claim 1, wherein the peripheral surface (48) comprises fingers (44) lined up in a row.

11. The folding device (14', 14") according to claim 1, wherein the contact device (15', 15") has a contact device length (ML) and a contact device width (MW); and wherein a dimension ratio LWR equals the contact device length (ML) divided by the contact device width (MW) and wherein the dimension ratio LWR is larger than 0.5.

12. A folding system (10) configured for continuously creating at least one fold along a respective fold line (20) in an article (12) during motion thereof, the folding system (10) comprising:

a folding device (14', 14") comprising a driven contact device (15', 15") configured for continuously creating a fold in a moving article (12) during an operative folding mode of the folding device (14' 14"); the folding device (14', 14") orientation being defined with respect to a three dimensional euclidean space described by first, second and third axes (X, Y, Z);

in the operative folding mode, the article (12) moving along a base plane (P) defined by, the first and second axes (X y) in a motion direction (MD) parallel to the first axis (X); the folding device (14', 14") comprising a support structure (54) connected to, and configured for supporting, the contact device (15', 15"), the contact device (15', 15") comprising a peripheral surface (48) extending at least partially about at least one rotation axis (R, R1, R2); the peripheral surface (48) comprising multiple elongated fingers (44) protruding outwardly away therefrom;

wherein in the operative folding mode of the folding device (14' 14"), the fingers (44) consecutively engage, and incrementally fold, the article (12);

the folding system (10) further comprising a conveyor (18) configured for conveying the article (12) in a motion direction (MD); before being folded, the article (12) comprising a first article surface (24) facing away from the conveyor (18) and a second article surface (26) facing and contacting the conveyor (18); and a holding member (16) comprising a holding member edge (30), only the holding member (16) configured for holding at least a portion of the article (12) in a direction perpendicular to the motion direction (MD) during folding, and configured for defining a fold line (20) in the article (20) along the holding member edge (30).

13. The folding system (10) according to claim 12, wherein the holding member (16) does not rotate.

14. The folding system (10) according to claim 12, wherein in the operative folding mode of the folding system (10), the fold is created in the article (12) only during relative motion in the motion direction (MD) between the article (12) and the folding device (14', 14").

15. The folding system (10) according to claim 12, wherein the at least one rotation axis (R) of the contact device (15', 15") is not perpendicular to the motion direction (MD).

16. The folding system (10) according to claim 12, wherein at least one finger (44) is configured to contact the conveyor (18) if no article is located therebetween.

17. The folding system (10) according to claim 12, wherein the contact device (15") comprises first and second parallel pulleys (52*a*, 52*b*) and at least one belt (46) which is stretched thereabout.

18. The folding system (10) according to claim 12, wherein the folding system (10) comprises two folding devices (14"), and wherein the respective rotation axes (R) diverge along the motion direction (MD).

19. A continuous article folding method comprising:

(a) providing the at least one folding system (10) according to claim 12;

(b) enabling continuous relative motion in the motion direction (MD) between the article (12) and the at least one folding device (14', 14");

(c) holding the article (12) using the holding member (16);

(d) using the holding member edge (30) and establishing a fold line (20) location and orientation in the article (12); and (e) continuously engaging the second article surface (26) using the fingers (44) and collecting and folding the article (12) over the fold line (20) at least in a direction perpendicular to the motion direction (MD).

20. An article folding method for folding an article (12) using the folding device (14', 14") of claim 10, and comprising a first article surface (24) facing in a first direction, a second article surface (26) facing in a second direction opposite to the first direction, opposing first and second article lateral edges (28*a*, 28*b*), and an article centerline (CL) passing between the article lateral edges (28*a*, 28*b*), the method comprising:

(a) conveying the article (12) in a motion direction (MD) which coincides with an article central axis (CL); and (b) while the article moves in the motion direction (MD), successively collecting and folding incremental portions of the article's first lateral edge (28*a*) towards the center line (CL), until at least an entire section of the first lateral edge (28*a*) is folded over the second article surface (26).

* * * * *